US005402543A

United States Patent [19]

Dietrich et al.

[11] Patent Number: 5,402,543

[45] Date of Patent: Apr. 4, 1995

[54] PATIENT SUPPORT APPARATUS INCLUDING STABILIZING MECHANISM

[75] Inventors: Daniel Dietrich, Medina; Raymond A. Failor, Seville, both of Ohio

[73] Assignee: Hausted, Inc., Medina, Ohio

[21] Appl. No.: 98,591

[22] Filed: Jul. 26, 1993

[51] Int. Cl.[6] ..... A61G 7/00; A61G 7/005

[52] U.S. Cl. ..... 5/610; 5/14; 5/618

[58] Field of Search ..... 5/610, 613, 614, 616, 5/617, 618; 254/93 R

[56] References Cited

U.S. PATENT DOCUMENTS 4,858,260 8/1989 Failor et al. ..... 5/430

OTHER PUBLICATIONS

Brochure dated Feb. 1992 describing Stryker © OB--GYN Procedural Stretcher Model 1060.

*Primary Examiner*—Alexander Grosz

*Attorney, Agent, or Firm*—Hoffmann & Baron

[57] ABSTRACT

A patient support apparatus such a surgical table or a stretcher is provided. The apparatus includes a top assembly for supporting a patient in a variety of selected positions. The top assembly is supported by first and second hydraulic column assemblies which are, in turn, mounted to a base assembly. A stabilizing mechanism is provided for exerting a constant downward force upon the hydraulic column assembly supporting the head end of the top assembly. The stabilizing mechanism counteracts the lifting force at the head end of the apparatus when a patient's weight is located at or beyond the foot end thereof. The stabilizing mechanism includes a gas spring which is mounted to the base assembly and a cable connected between the base assembly and top assembly. The gas spring exerts a constant force upon the cable in all elevational positions of the top assembly.

26 Claims, 4 Drawing Sheets

FIG. 4
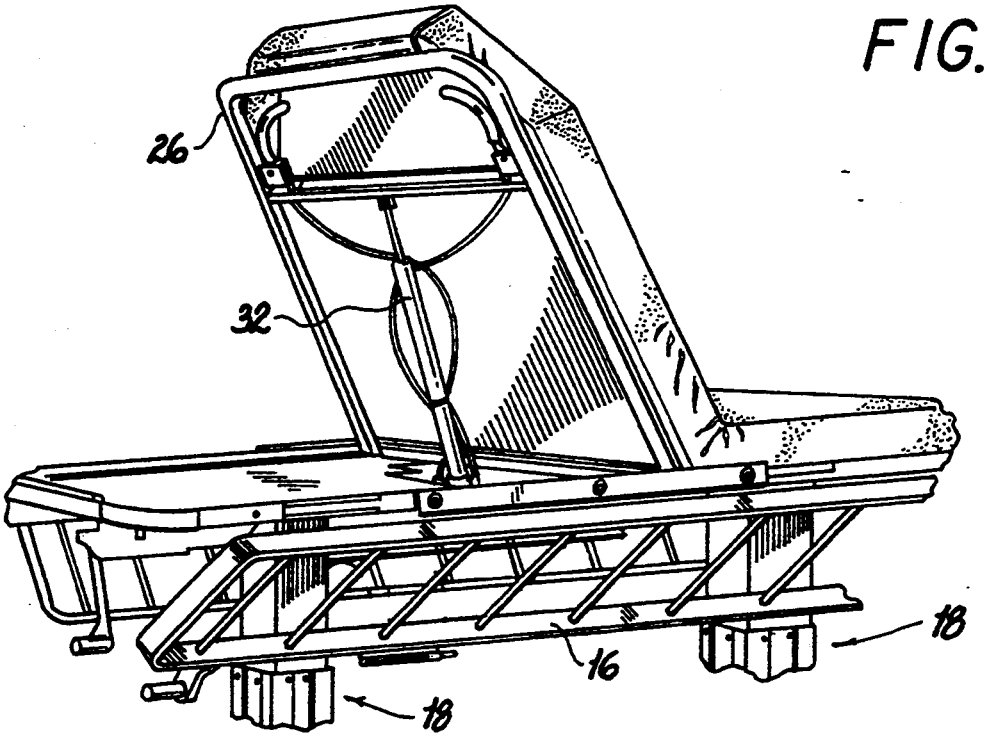
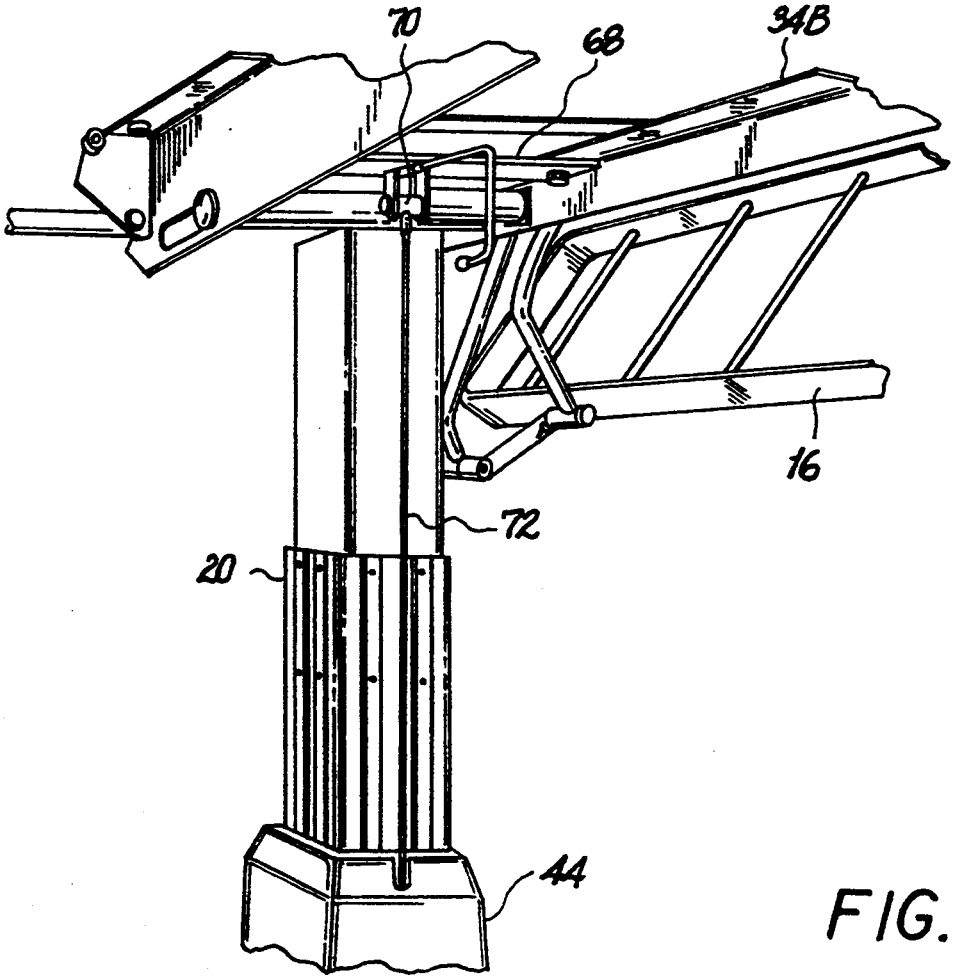
FIG. 5

PATIENT SUPPORT APPARATUS INCLUDING STABILIZING MECHANISM

BACKGROUND OF THE INVENTION

1. Field of the Invention

The field of the invention relates to patient support apparatus such as stretchers and other patient handling equipment, and particularly to such apparatus including stabilizing mechanisms for preventing tipping thereof when a patient's weight is towards one end of the apparatus.

2. Brief Description of the Related Art

Patient handling equipment, such as stretchers and surgical tables and the like, have been designed for many uses. Such equipment may be capable of providing a full range of stretcher and chair positions, thereby providing a great deal of versatility.

Height adjustment of patient handling equipment is often provided through the use of one or more hydraulic column assemblies. Controls are provided for operating these assemblies. It is important that, upon use of the controls, the hydraulic column assemblies cause a steady ascent or descent of the patient support portion of the apparatus, whichever is desired.

The stability of patient handling equipment is another important consideration, particularly when a patient is supported by such equipment. By moving such equipment between stretcher and various other configurations, such as chair or obstetric/gynecological positions, the patient's weight is shifted towards one end of the equipment. This can cause the telescoping of the hydraulic column assembly at the opposite end of the equipment, typically the head end, unless it is in the fully elevated position. The negative load at the head end may also prevent this end from lowering properly upon actuation of the controls.

The problem resulting from the application of unequal forces upon a patient support apparatus have been recognized by the industry, and various approaches have been taken for addressing them. One approach for lowering a column assembly having a negative load thereon has been to manually exert a downward force at one end of the apparatus. The inconvenience associated with this procedure is readily apparent. A second approach has been to add weight to the head end of the unit for exerting a counterbalancing force. The mobility of the apparatus, however, is compromised by the addition of such weight.

SUMMARY OF THE INVENTION

It is an object of the invention to provide a patient support apparatus which is capable of supporting a patient in a variety of positions.

It is another object of the invention to provide such an apparatus which is stable regardless of where the patient's weight is concentrated on the apparatus.

A still further object of the invention is to provide an apparatus which ensures steady ascent or descent of the top portion of the apparatus in all positions thereof.

A still further object of the invention is to provide an apparatus which is relatively easily maneuvered by medical personnel.

In accordance with these and other objects of the invention, which will become apparent from the detailed description which follows, a patient support apparatus is provided which includes a top assembly, a base assembly, first and second hydraulic column assemblies mounted to the base assembly for supporting the top assembly, and means connected between the base assembly and top assembly for exerting a downward force on one of the hydraulic column assemblies. In a preferred embodiment of the invention, the means for exerting a downward force include a gas spring connected by a cable to the top assembly. The gas spring resiliently urges the hydraulic column assembly adjoining the head end of the apparatus towards a contracted position, thereby substantially counteracting the lifting force at the head end of the apparatus when a patient's weight is concentrated towards the foot end thereof. The hydraulic column assembly does not actually move towards a contracted position until control means are actuated by an operator. The force exerted by the gas spring insures that the hydraulic column assembly does, in fact, contract, even when a patient's weight is towards or beyond the foot end of the apparatus.

BRIEF DESCRIPTION OF THE DRAWINGS

FIG. 4 is a rear perspective view of the top portion of the surgical table;

FIG. 5 is a perspective view showing a head end column and underside of the surgical table.

DETAILED DESCRIPTION OF THE INVENTION

Figure 1:
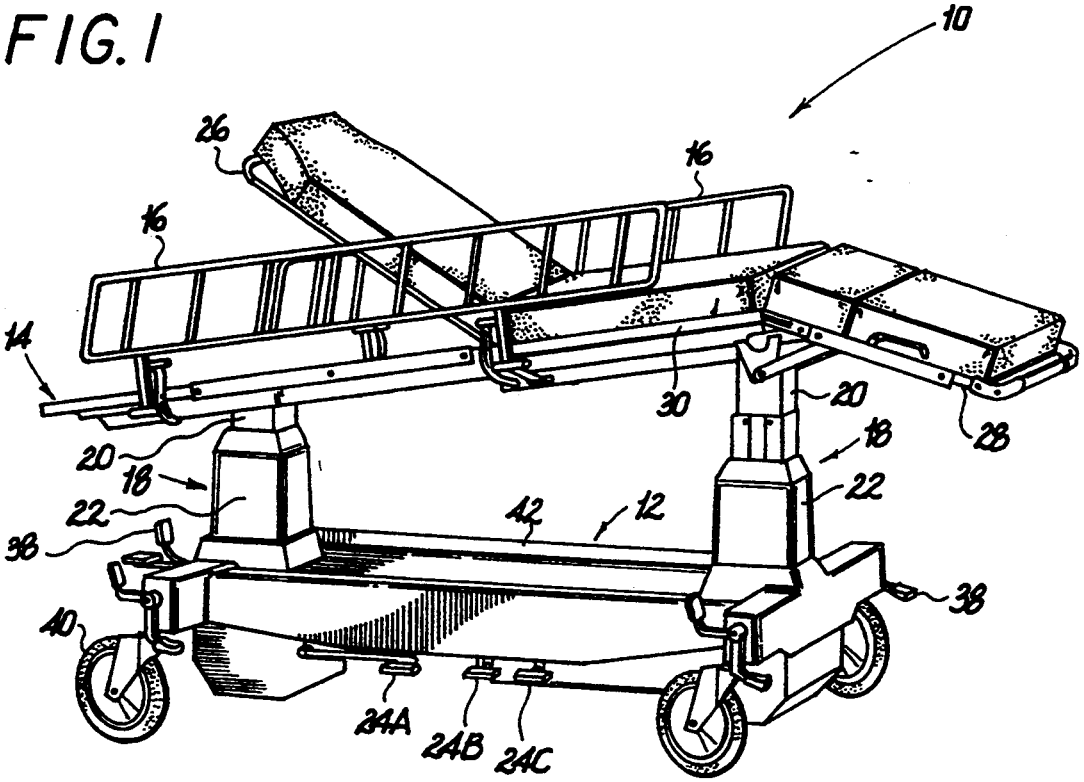
FIG. 1 is a front perspective view of a mobile surgical table according to the invention in a pre-induction position.

A patient support apparatus in accordance with the invention is shown in FIG. 1 in the form of a mobile surgical table 10. The table 10 is capable of infinite positioning capabilities from sitting to supine, and can accordingly be used for a wide variety of applications.

The surgical table includes a base assembly 12, a top assembly 14, a pair of side rails 16 mounted to the top assembly, and a pair of hydraulic column assemblies 18 mounted to the base assembly. The hydraulic column assemblies support the top assembly 14.

Each hydraulic column assembly includes an elongate member 20 telescopingly coupled to a hydraulic actuator 22. Telescoping movement of one or both members 20 with respect to the actuator 22 allows the top assembly to be lowered, raised or moved to a Trendelenburg or other position. The hydraulic column assemblies are preferably the type which include flow control valves so that the top assembly can be lowered at a constant rate regardless of the weight supported thereby or the force exerted thereon. Such hydraulic column assemblies are commercially available to the industry. One such assembly is sold by Applied Power Inc. as the MEDIJACK Model DSC5. It is sold under the trademark POWER-PACKER. The control system for the hydraulic column assemblies include foot pedals 24A, 24B, 24C to adjust the height or to provide Trendelenburg or reverse Trendelenburg positions.

The top assembly 14, also known as a litter top, includes a Fowler backrest 26, a leg rest 28, and a seat portion 30. The Fowler backrest and leg rest are both pivotably mounted with respect to the seat portion. The positions thereof may be adjusted using any one of several well known adjustment mechanisms, including pneumatic spring assemblies. A pneumatic spring 32 for adjusting the Fowler backrest 26 is shown in FIG. 4. A top frame assembly 34 is provided for supporting the Fowler backrest 26, leg rest 28 and seat portion 30. The pneumatic spring assembly 32 is pivotably connected between the Fowler backrest 26 and the frame assembly 34 defined by angle members 34 *a* and 34*b*

Figure 3:
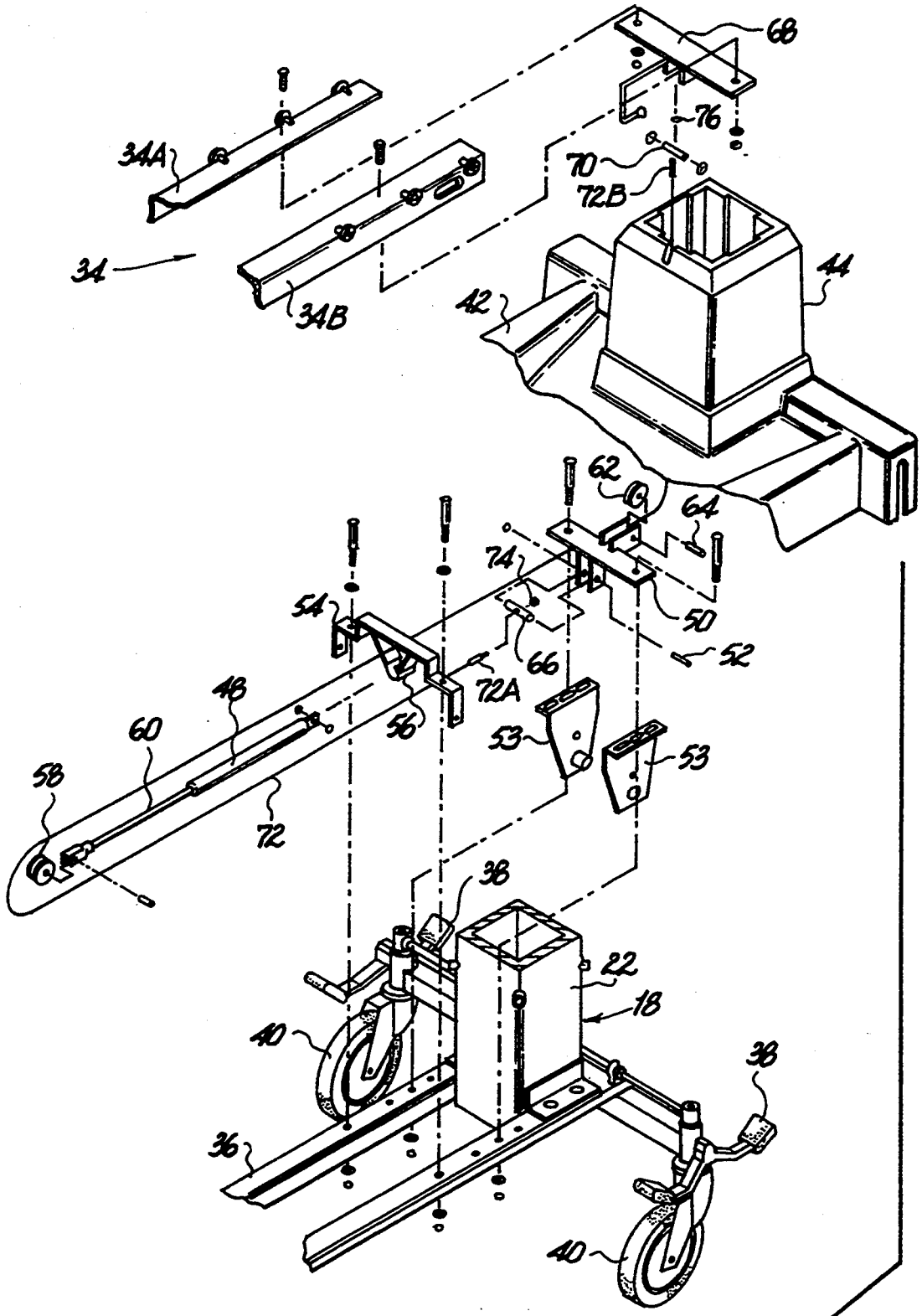
FIG. 3 is an exploded, perspective view of a stabilizing mechanism for urging the head end of the surgical table downwardly.
Figure 6:
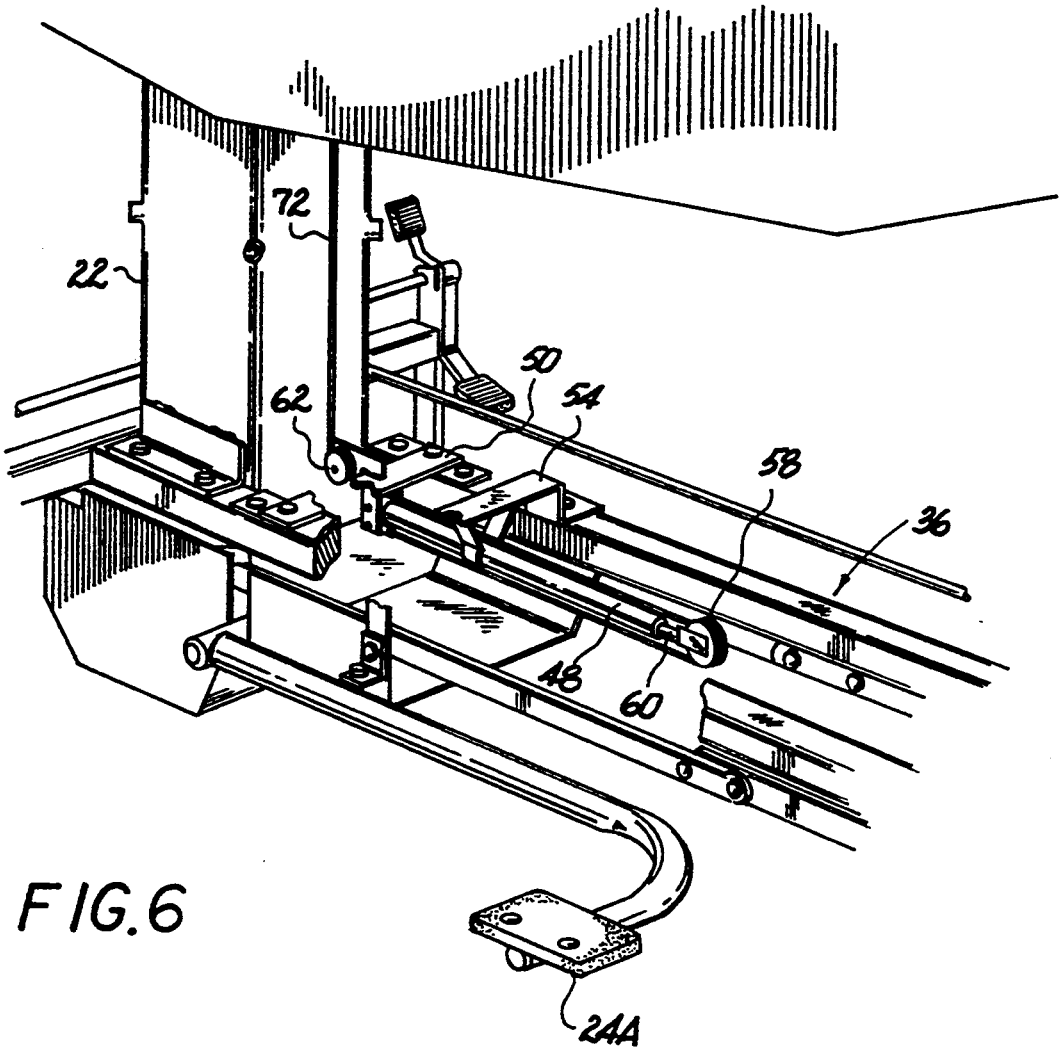
FIG. 6 is a cutaway, perspective view of the head end column and part of the stabilizing mechanism.

The base assembly 12 includes a base frame 36 as shown in FIG. 3, to which the hydraulic column assemblies 18 are mounted. A four wheel brake and steer caster system is mounted to the frame. Brake and steer pedals 38 are located on all four casters 40. A similar arrangement is disclosed in commonly assigned U.S. Pat. No. 4,858,260, which is incorporated by reference herein. The '260 patent also discloses a pneumatic spring used for maintaining the angular position of a backrest with respect to a seat.

A cover 42 is mounted to the frame for functional and aesthetic purposes. The cover includes a pair of hollow columns 44 which protect the hydraulic actuators. It further includes trough-like upper surface which may be used for transporting articles beneath the litter top. The cover also covers a large portion of the frame 36 as well as a stabilizing mechanism 46 mounted in part to the frame.

The stabilizing mechanism 46 is provided for constantly exerting a downward force to the hydraulic column assembly at the head end of the surgical table 10. In accordance with the preferred embodiment of the invention, the stabilizing mechanism includes a constant extension force gas spring 48 capable of providing a force of about 510 Newtons. The spring 48 is attached to a lower plate assembly 50 by a clevis pin 52. The lower plate assembly is, in turn, bolted to the base frame 36 of the surgical table 10. A pair of L-shaped brackets 53 are also secured to the base frame 36, and are positioned between the lower plate assembly and the base frame. A guide support 54 is also bolted to the base frame 36. The guide support includes a cylindrical guide portion 56 through which the body portion of the gas spring extends. The gas spring is accordingly mounted in a substantially horizontal position upon the base frame.

A pulley 58 is secured to the end of the piston rod 60 of the gas spring. The pulley is preferably made from a polymeric material such as nylon or an acetal resin (e.g. DELRIN). A second pulley 62 is rotatably mounted to the lower plate assembly 50 by a clevis pin 64. A pivot shaft 66 having an opening extending diametrically therethrough is also mounted to the lower plate assembly 50.

A top plate assembly 68 is bolted to the top assembly 14 of the surgical table in adjoining relation to the head end hydraulic column assembly. Specifically, it is bolted to a pair of opposing angle members 34A, 34B of the frame assembly 34. The top plate assembly includes a pivot shaft 70 secured thereto which is substantially identical in construction to the pivot shaft 66 mounted to the lower plate assembly.

A cable 72 having a pair of threaded ends 72A, 72B is coupled to the lower and top plate assemblies. One threaded end 72A extends through the opening in one of the pivots shafts and is coupled thereto by a hex nut 74. The other end 72B is coupled to the other pivot shaft 70 by a second hex nut 76. The cable extends from the first pivot shaft 66, around the pulleys 58, 62, through one of the hollow columns 44, and through thee second pivot shaft 70 to which it is coupled.

The stabilizing mechanism 46 is designed to prevent a lifting or tipping upward of the hydraulic column assembly at the head end of the surgical table 10 when a patient's weight is over the foot end of the apparatus. When the litter top is at its lowest elevational position, the gas spring 48 is extended in length, thereby taking up the cable length to the top surface mounting at the top plate assembly 68. The gas spring accordingly exerts a constant force to the cable and top assembly 14. As the litter top is elevated, the cable 72 forces the piston rod 60 of the gas spring inwardly. The gas spring accordingly continues to exert a downward force near the head end of the litter top. Such a downward force continues through the full elevation of the litter top. As the litter top is lowered, the piston rod of the gas spring extends under force to maintain the cable 72 in a taut condition, thereby exerting a constant downward load or pulling force upon the top assembly 14. Such a load is exerted regardless of where the patient's weight is concentrated. The pulleys 58, 62 contribute to the smoothness of the movements of the load-bearing cable 72.

The stabilizing mechanism 46 is designed for relatively simple adaptation to many existing surgical tables and stretchers having dual hydraulic column assemblies. It can be incorporated within many such tables and stretchers either during original manufacture or by retrofitting through the use of bolt-on hardware the same as or similar to that described above. The mechanism 46 occupies little space, and accordingly requires, at most, minimal modifications to existing equipment in order to employ it therewith.

By constantly exerting a downward force upon the head end hydraulic column assembly, the stabilizing mechanism ensures that the head end of the surgical table or stretcher will lower upon actuation of the assembly even when a patient's weight is concentrated towards the foot end thereof. In addition, lifting or telescoping of the head end hydraulic column assembly will be prevented regardless of where a patient's weight is concentrated. As the stabilizing mechanism weighs less than ten pounds, these benefits are achieved with virtually no sacrifice of mobility. No manual force is necessary for lowering the litter top. As the hydraulic column assemblies are preferably of the type which raise or lower a litter top at substantially the same speed regardless of the force applied to the litter top, the stabilizing mechanism does not affect the normal operation thereof.

Figure 2:
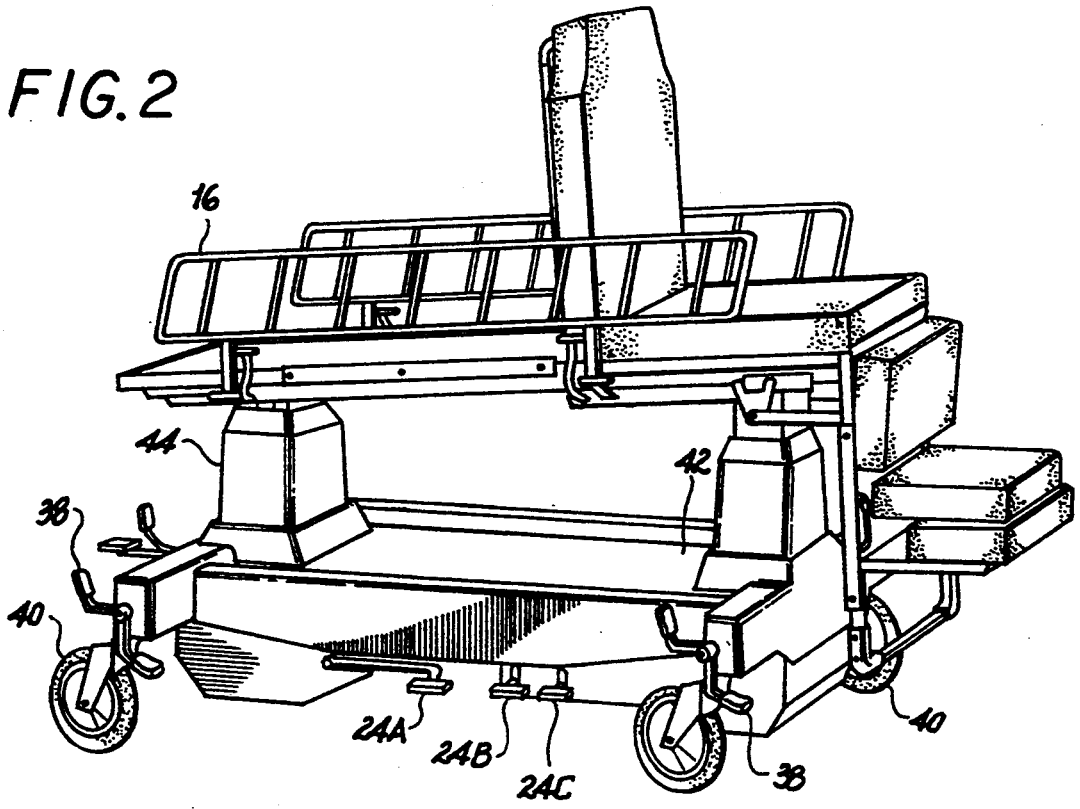
FIG. 2 is a front perspective view thereof in a post-anesthesia position.

The benefits of the invention become particularly apparent when the stabilizing mechanism is used in a stretcher or surgical table having a top assembly capable of supporting a patient in a number of different positions. This capability inherently causes the shifting of a patient's weight such that, in units having dual hydraulic support assemblies, one of the hydraulic assemblies would be subjected to a negative force under certain circumstances. A patient's weight, for example, would be sufficiently distributed when the surgical table 10 is in the position shown in FIG. 1 that a negative force would not be exerted upon the hydraulic support assembly at the head end thereof. When the surgical table is moved to the position shown in FIG. 2, however, there is a likelihood that such a negative force would be exerted upon the head end hydraulic support assembly, and that this force will prevent proper operation of the assembly should the control pedals 24A, 24B or 24C be operated. The stabilizing mechanism provides a force to the hydraulic column assembly most likely to be subjected to such a negative force. This pulling force is sufficient to overcome the negative force anticipated under most operating conditions. A single gas spring capable of exerting a force of about 510 Newtons has been found to provide satisfactory results. It will be appreciated that the stabilizing mechanism can be designed to include more than one spring.

While the stabilizing mechanism 46 according to the preferred embodiment of the invention is secured directly to the upper frame assembly 34 and base frame 36, respectively, it will be appreciated that such a mechanism can be designed for mounting, at least in part, to hydraulic column assembly 18 itself. The mechanism would be, under such circumstances, only indirectly connected to the upper frame assembly and/or base frame, respectively. The particular points at which a stabilizing mechanism are secured must, however, be such that the mechanism provides a downward force upon the extensible portion of the hydraulic column assembly.

As discussed above, a gas spring is employed in accordance with the preferred embodiment of the invention for providing a downward force upon the hydraulic column assembly at the head end of the surgical table. Such a spring is preferred as it exerts substantially the same force upon the hydraulic column assembly regardless of the position of the litter top. Alternatively, a mechanism could be employed which exerts a variable downward force upon the hydraulic column assembly depending upon the position of the litter top. An elastic member, coil spring(s), or the like could be directly or indirectly connected between the upper frame assembly and base frame in order to exert a constant, though variable force upon the hydraulic column assembly, depending upon the position of the litter top. Since the hydraulic column assemblies are preferably of the type which expand or contract at a substantially constant rate regardless of load, such approaches for counteracting the negative forces thereon are at least feasible.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A patient support apparatus comprising:

a top assembly;

a base assembly;

first and second hydraulic column assemblies mounted to said base assembly and supporting said top assembly;

means connected between said top assembly and said base assembly for exerting a downward force on said first hydraulic column assembly.

2. An apparatus as described in claim 1, wherein said top assembly in includes a top frame and said base assembly includes a base frame, said means for exerting a downward force being connected to said base frame and said top frame.

3. An apparatus as described in claim 2, wherein said means for exerting a downward force include a gas spring.

4. An apparatus as described in claim 3, wherein said gas spring is mounted to said base frame, and further including a cable connected to said top frame, said gas spring exerting a constant force upon said cable such that a downward force is exerted upon said first hydraulic column assembly.

5. An apparatus as described in claim 4, wherein said cable is connected to said top frame in adjoining relation to said first hydraulic column assembly.

6. An apparatus as described in claim 4, wherein said gas spring is mounted in a substantially horizontal position to said base frame.

7. An apparatus as described in claim 1, wherein said means for exerting a downward force include spring means for resiliently urging said first hydraulic column assembly towards a contracted position.

8. An apparatus as described in claim 1, wherein said means for exerting a downward force include a stabilizing mechanism including spring means and means for connecting said spring means to said base assembly, and wherein said hydraulic column assemblies are capable of contracting at substantially the same rate regardless of load thereon.

9. An apparatus as described in claim 8, including a cable, means for directly connecting an end of said cable to said top assembly, and means for directly connecting an end of said cable to said base assembly, whereby said spring means exerts a force upon said cable in all positions of said top assembly with respect to said base assembly.

10. A patient support apparatus comprising:

a top assembly including a head end and a foot end;

a base assembly;

first and second hydraulic column assemblies mounted to said base assembly and supporting said head end and said foot end of said top assembly, respectively;

control means for actuating said first and second hydraulic column assemblies, and means for resiliently urging said first hydraulic column assembly towards a contracted position, whereby a sufficient force is exerted upon said first hydraulic column assembly such that a lifting force at said head end due to a patient's weight at or beyond said foot end of said top assembly is substantially counteracted, thereby allowing said head end to be lowered upon operation of said control means despite the presence of such a lifting force.

11. An apparatus as described in claim 10, wherein said means for resiliently urging include a gas spring.

12. An apparatus as described in claim 11, including a cable connected to said top assembly, said gas spring exerting a constant force upon said cable.

13. An apparatus as described in claim 12, wherein said cable is connected to said base assembly and said gas spring is mounted in a substantially horizontal position to said base assembly.

14. An apparatus as described in claim 13, wherein said gas spring includes a piston rod and a pulley secured to said piston rod, said cable being trained about said pulley.

15. An apparatus as described in claim 10, wherein said means for resiliently urging provides a substantially constant force to said first hydraulic column assembly in all positions of said top assembly with respect to said base assembly.

16. An apparatus as described in claim 10, wherein said first hydraulic column assembly is capable of contracting at substantially the same rate regardless of load thereon.

17. A patient support apparatus comprising:

a top assembly having a head end and a foot end and an upper surface for supporting a patient;

means for supporting said top assembly, said supporting means including a hydraulic column assembly supporting said head end of said top assembly and capable of raising and lowering said head end;

a second column assembly supporting said foot end of said top assembly and capable of raising and lowering said foot end;

means for urging said hydraulic column assembly towards a contracted position, and connecting means for operatively connecting said means for urging between said top assembly and said supporting means.

18. An apparatus as described in claim 17, wherein said means for urging include a spring.

19. An apparatus as described in claim 18, wherein said spring is capable of exerting a substantially constant force upon said hydraulic column assembly regardless of the position of said head end.

20. An apparatus as described in claim 17, wherein said means for urging include an extensible member which increases in length as said head end is moved in a first direction with respect to said supporting means and decreases in length as said head end is moved in a second direction by said hydraulic column assembly.

21. An apparatus as described in claim 20, wherein said extensible member is a spring and said connecting means include a cable, said spring exerting a constant force upon said cable.

22. An apparatus as described in claim 17, wherein said hydraulic column assembly is capable of contracting at substantially the same rate regardless of load thereon.

23. A patient support apparatus comprising:

a top assembly including a head end and a foot end;

a base assembly;

first and second hydraulic column assemblies mounted to said base assembly for supporting said head end and said foot end of said top assembly respectively;

control means for actuating said first and second hydraulic column assemblies, and means for exerting a substantially constant, pulling force upon said top assembly such that a lifting force at said head end due to a patient's weight at or beyond said foot end of said top assembly is substantially counteracted, thereby allowing said head end to be lowered upon operation of said control means despite the presence of such a lifting force.

24. An apparatus as described in claim 23, wherein said pulling force is substantially the same magnitude regardless of the position of said top assembly with respect to said base assembly.

25. An apparatus as described in claim 23, wherein said hydraulic column assemblies are capable of contracting at substantially the same rate regardless of load thereon.

26. An apparatus as described in claim 23, wherein said means for exerting include a spring.

* * * * *